United States Patent [19]

Ledesma

[11] 4,068,312

[45] Jan. 17, 1978

[54] ATHLETIC KNEE GUARD

[76] Inventor: Thomas Ledesma, 774 N. 16th St., San Jose, Calif. 95112

[21] Appl. No.: 740,564

[22] Filed: Nov. 10, 1976

[51] Int. Cl.[2] ..... A41D 13/06

[52] U.S. Cl. ..... 2/24; 128/80 C

[58] Field of Search ..... 2/2, 2.1 R, 2.1 A, 22, 2/24; 128/80 R, 80 C, 87 R, 88, 89 R, 165; 3/2, 22

[56] References Cited

U.S. PATENT DOCUMENTS

| | | | |
|---|---|---|---|
| 1,862,303 | 6/1932 | Glahe | 2/24 |
| 2,433,768 | 12/1947 | Krupp | 2/2.1 A |
| 2,640,989 | 6/1953 | Woodward | 2/22 |
| 3,034,131 | 5/1962 | Lent | 2/2.1 R |
| 3,242,499 | 3/1966 | Fonda-Bonardi | 2/2.1 R |
| 3,528,412 | 9/1970 | McDavid | 2/22 X |
| 3,575,166 | 4/1971 | Rosman et al. | 2/22 X |
| 3,898,697 | 8/1975 | Whitehead | 2/22 |

*Primary Examiner*—Werner H. Schroeder
*Assistant Examiner*—Moshe I. Cohen
*Attorney, Agent, or Firm*—Phillips, Moore, Weissenberger, Lempio & Majestic

[57] ABSTRACT

The invention is concerned with a protective knee guard which is useful for protecting an athlete's knee from injury during athletic events and practice sessions. The knee guard comprises a first rigid shell of generally hemicylindrical shape for resting generally matingly against a front portion of a person's leg slightly above the person's knee, the first shell including a pair of arms extending generally downwardly and rearwardly therefrom, each to a respective position on opposite sides of the person's knee. A second rigid shell of generally hemicylindrical shape rests generally matingly against the front portion of a person's leg slightly below the person's knee, the second shell including a pair of arms extending generally upwardly and rearwardly therefrom, each to a respective one of the positions on opposite sides of the knee. Straps, bands or the like are provided for attaching the first shell above the person's knee and the second shell below the person's knee. A plurality of rigid generally arcuate bars are provided each extending from a respective one to a respective other of the positions on opposite sides of the knee with a central portion of each bar located forward of the knee, the central portions being progressively spaced one from another from the first rigid shell to the second rigid shell. A pair of pivots are provided one at each of the positions, each pivot pivotally connecting a respective arm of the first shell, a respective arm of the second shell and a respective end portion of each of the arcuate bars to pivot thereabout. Also, fabric is provided interconnecting successive arcuate bars to one another, connecting an uppermost one of the arcuate bars to the first rigid shell and connecting a lowermost one of the arcuate bars to the second rigid shell.

8 Claims, 4 Drawing Figures

ATHLETIC KNEE GUARD

BACKGROUND OF THE INVENTION

1. Field of the Invention

The invention relates to protective gear for use particularly in contact sports such as football, rugby, ice hockey, field hockey, and the like.

2. Prior Art

The prior art teaches a number of protective gears useful at joints such as at the knee or the like. However, each of these protective knee guards has one or another disadvantage. Some of the knee guards of the prior art are too heavy or rigid and do not allow a user to have sufficient flexibility for running as is required in most contact sports. Other prior art devices do not provide sufficient protection. Typical prior art protective devices as may be used for knees are discussed, for example, in U.S. Pat. Nos. 3,742,517 and 3,898,697. A protective device for finger or knee joints is also discussed in U.S. Pat. No. 3,513,842.

The present invention is particularly concerned with providing a protector device which in no way hinders a user thereof from running or otherwise making use of his or her knee but would still provide extremely adequate protection to the knee, especially when the knee is straightened which is the time when injury may most easily occur. While certain articulated joints have been used in space suit designs and diving suit designs as illustrated for example by any of U.S. Pat. Nos. 2,939,148; 3,242,499; and 3,421,158, none of these articulated joints have the structure or accomplishes the purpose and serves the function of the knee guard of the present invention.

SUMMARY OF THE INVENTION

It is therefore a principal object of the present invention to provide a knee guard which will provide adequate leg protection during contact sports.

It is a further object of the present invention to provide such a knee guard which will also allow full flexing of the knee for running, turning, and the like during contact sports.

Yet another object of the present invention is to provide a knee guard which assumes substantially full rigidity on straightening of the knee thus providing maximum protection when the knee is straight.

Another object still of the present invention is to provide a knee guard which is padded and attached to the leg above and below the knee and which will distribute forces delivered towards the knee to shells located above and below the knee.

The invention then comprises a knee guard useful for protecting an athlete's knee from injury. The knee guard comprises a first rigid shell of generally hemicylindrical shape for resting generally matingly against the front portion of a person's leg slightly above the person's knee, said first shell including a pair of arms extending generally downwardly and rearwardly therefrom, each to a respective position on opposite sides of said knee. The knee guard futher comprises a second rigid shell of generally hemicylindrical shape for resting generally matingly against a front portion of a person's leg slightly below the person's knee, said second shell including a pair of arms extending generally upwardly and rearwardly therefrom, each to a respective one of said positions on opposite sides of said knee. Means are provided for attaching the first shell above the person's knee and means are provided for attaching the second shell below the person's knee. A plurality of rigid generally arcuate bars, each extending from a respective one to a respective other of the positions on opposite sides of the knee with a central portion of each bar forward of the knee, said central portions being progressively spaced one from another from the first rigid shell to the second rigid shell are likewise a part of the knee guard. A pair of pivot means are provided one at each of the positions, each pivot means pivotally connecting a respective arm of the first shell, a respective arm of the second shell and a respective end portion of each of the arcuate bars to pivot thereabout. Fabric is provided interconnecting the successive arcuate bars to one another, connecting an uppermost one of the arcuate bars to the first rigid shell and connecting a lowermost one of the arcuate bars to the second rigid shell.

BRIEF DESCRIPTION OF THE DRAWINGS

The invention will be better understood by reference to the figures of the drawings and other objects of the invention will become more readily apparent upon study of the following specification and the accompanying drawing wherein like numbers denote like parts throughout and wherein.

DETAILED DESCRIPTION OF THE PREFERRED EMBODIMENT

Figure 1:
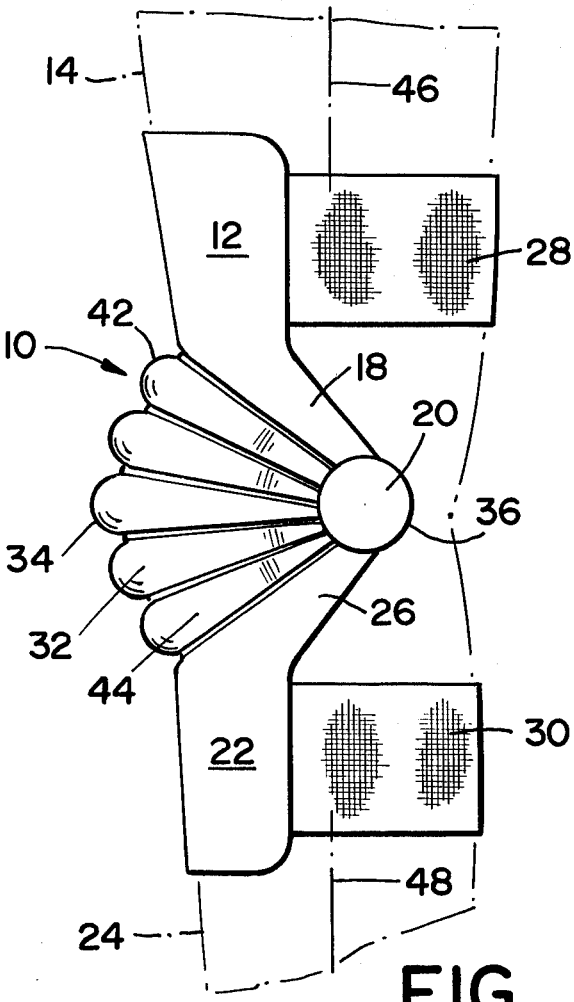
FIG. 1 illustrates in side view a persons leg having the knee guard of the present invention thereon.

In accordance with the present invention a knee guard 10 is provided which includes a first rigid shell 12 of generally hemicylindrical shape for resting generally matingly against a front portion 14 of a person's leg 16 slightly above the person's knee. A pair of integral arms 18 proceed rearwardly and downwardly to positions 20 on opposite sides of the knee. A second rigid shell 22 of generally hemicylindrical shape is provided and rests generally matingly against a front portion 24 of the leg 16 slightly below the person's knee. The second shell 22 includes a pair of integral arms 26 extending generally upwardly and rearwardly therefrom each to a respective one of the positions 20 on opposite sides of the knee.

Means are provided for attaching the first shell 12 above the person's knee and for attaching the second shell 22 below the person's knee. In the embodiments illustrated the attaching means for the first shell comprise an elastic strap 28 and the means for attaching the second shell 22 comprises another elastic strap 30. It is clear that the elastic straps can be replaced, for example with buckle adjustable straps of a non-elastic nature or the like.

A plurality of rigid generally arcuate bars 32 form an essential part of the knee guard 10. Each of the bars 32 extends from a respective one to a respective other of the positions 20 on opposite sides of the person's knee. A central portion 34 of each of the bars 32 is located forward of the person's knee. The central portions of each of the bars 32 are progressively spaced one from another from the first rigid shell 12 to the second rigid shell 22. Each of the bars 32 preferably bulges away from the person's knee adjacent the central portion 34 thereof to provide added elasticity and hence resistance to blow thereto.

A pair of pivot means are provided, one at each of the positions 20. In the embodiment illustrated each of these pivot means comprises a pin 36. Each of the pins 36 pivotally connects a respective arm 18 of the first shell 12, a respective arm 26 of the second shell 22 and each respective end portion 38 of the bars 32 to pivot thereabout. The pin 36 serves to transmit force which may be exerted against the central portions 34 of the bars 32 to the first shell 12 and the second shell 22 via the respective arms 18 and 26. The pivotal attachment of the bars 32 and the arms 18 and 26 to the pin 36 allow flexing of the knee to take place to any desired extent.

Fabric 40 serves to interconnect the successive arcuate bars 32 to one another. The fabric 40 also connects an uppermost one 42 of the arcuate bars 32 to the first rigid shell 12 and connects a lowermost one 44 of the arcuate bars 32 to the second rigid shell 22.

When the leg 16 is straight as when the person's knee is straightened, the arcuate bars 32 abut one another at the central portions 34 thereof to form a continuous generally bulging outward guard surface from the first shell 12 to the second shell 22. Thus, when the knee is straightened force is transmitted from the bars 32 to the first shell 12 and the second shell 22 not only via the pin 36 and the respective arms 18 and 26 but also directly as by abutting of the uppermost bar 42 with the first shell 12 of the lowermost bar 44 with the second shell 22. This is especially advantageous since perhaps the greatest cause of damage to an athlete's knee is when the athlete's leg is straight and braced against the ground and the athlete's knee is struck by another player, thus delivering a force which would tend to force the knee joint in the wrong direction. It will be noted that in the instance when the person's knee is straightened, the uppermost one 42 of the arcuate bars 32 at the central portion 34 thereof abuts the first shell 12 and the lowermost one 44 of the bars 32 at the central portion 32 thereof abuts the second shell 22 whereby force transmission is direct and the bars 32 and first and second shells 12 and 22 form an essentially continuous knee shield.

Figure 2:
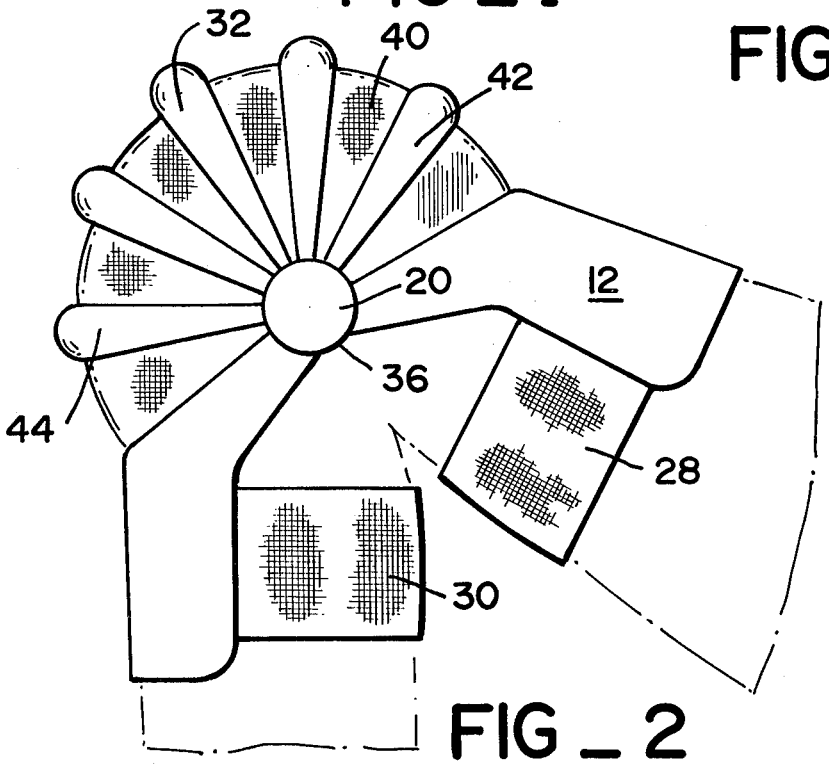
FIG. 2 illustrates in side view as in FIG. 1 a knee guard of the present invention on a persons leg with the leg bent at approximately a 90° angle.
Figure 4:
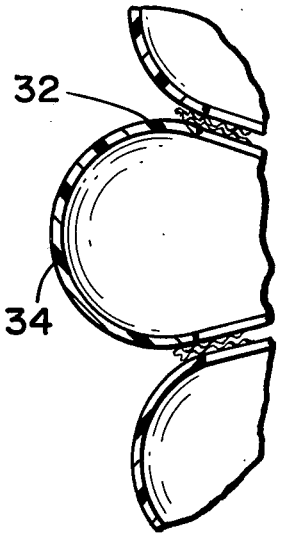
FIG. 4 illustrates a detail in the construction of the knee guard of the present invention.

Referring to FIG. 2 it is seen that the athlete's knee can be completely bent and that in this situation the fabric 40 will cause the arcuate bars 32 to be substantially evenly positioned about the knee to provide significant protection while the knee is in the bent position.

In order to most evenly distribute the forces upon the first shell 12 and the second shell 22, it is preferred that the arm 18 of the first shell proceed downwardly and rearwardly at an angle from a longitudinal axis 46 of the first shell 12 and that the arm 26 of the second shell 22 proceeds upwardly and rearwardly at generally an equal angle from a longitudinal axis 48 of the second shell 22. Generally, the longitudinal axes 46 and 48 will be coextensive or at least very close to one another when the leg is straightened.

Figure 3:
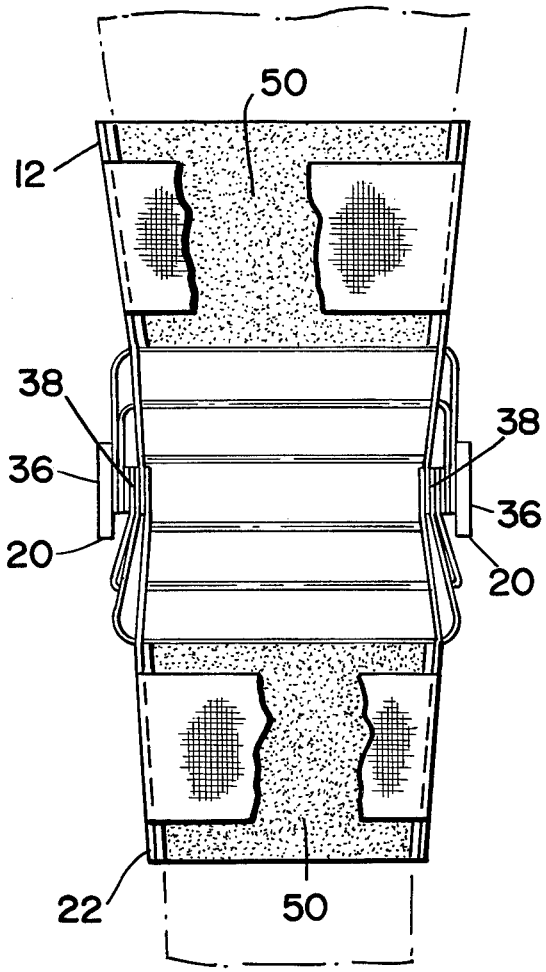
FIG. 3 illustrates a back view of the knee guard of the present invention.

Reference to FIG. 3 will illustrate pad means, in the embodiment illustrated the pads 50, which pad means are supported by the first shell 12 and the second shell 22 between the person's leg and each of the first shell 12 and the second shell 22. The pads 50 are generally necessary to provide sufficient comfort to the athlete wearing the knee guard 10.

As may also be seen by reference to the Figures, each of the bars 32 is so shaped whereby the end portions 38 thereof can matingly fit against one another at the pin 36 but also whereby the central portions 34 thereof will not nest within one another but must abut one another when the knee is straightened.

For adequate strength along with very desirable lightness of construction, the first shell 12, the second shell 22 and the bars 32 are preferebly made of a light but high strength material such as for example fiberglass. It is of course understood that the knee guard 10 can also be made out of metal, plastic covered metal, reinforced plastic, cloth covered metal or the like. However, the aforementioned fiberglass construction offers significant advantages for mass production technique, in lightness and in strength and rigidity. Further, fiberglass is sufficiently flexible so that the end portions 38 of the bars 32 can telescopically fit over one another while the central portions 34 of the bars 32 are located whereby they must abut one another when the knee is straightened.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

That which is claimed is:

1. A knee guard useful for protecting an athlete's knee from injury, comprising:

a first rigid shell of generally hemicylindrical shape for resting generally matingly against a front portion of a person's leg slightly above the person's knee, said first shell including a pair of arms extending generally downwardly and rearwardly therefrom, each to a respective position on opposite sides of said knee;

a second rigid shell of generally hemicylindrical shape for resting generally matingly against a front portion of a person's leg slightly below the person's knee, said second shell including a pair of arms extending generally upwardly and rearwardly therefrom, each to a respective one of said positions on opposite sides of said knee;

means for attaching said first shell above the person's knee;

means for attaching said second shell below the person's knee;

a plurality of rigid generally arcuate bars, each extending from a respective one to a respective other of said positions on opposite sides of said knee with a central portion of each bar forward of said knee, said central portions being progressively spaced one after another from said first rigid shell to said second rigid shell, said arcuate bars abutting one another to form a continuous guard surface from said first shell to said second shell when the person's knee is straightened, an uppermost one of said arcuate bars abutting said first shell and a lowermost one of said arcuate bars abutting said second shell when the person's knee is straightened;

a pair of pivot means, one at each of said positions, each pivot means pivotally connecting a respective arm of said first shell, a respective arm of said second shell and a respective end portion of each of said arcuate bars to pivot thereabout; and fabric interconnecting successive of said arcuate bars to one another and further connecting the uppermost one of said arcuate bars to said first rigid shell and connecting the lowermost one of said arcuate bars to said second rigid shell.

2. A knee guard as in claim 1, wherein said central portions of said bars bulge away from the person's knee.

3. A knee guard as in claim 2, wherein said arcuate bars are formulated of fiberglass.

4. A knee guard as in claim 3, wherein said first and second shells are formulated of fiberglass.

5. A knee guard as in claim 4, including:

pad means between the person's leg and each of said first and second shells.

6. A knee guard as in claim 5, wherein each of said pivot means comprises a pin.

7. A knee guard as in claim 6, wherein said arm of said first shell proceeds downwardly and rearwardly at an angle from a longitudinal axis of said first shell and said arm of said second shell proceeds upwardly and rearwardly at generally an equal angle from a longitudinal axis of said second shell.

8. A knee guard as in claim 7, wherein said means for attaching said first shell and said means for attaching said second shell each comprise elastic straps.

* * * * *